US007162964B2

(12) United States Patent
Vaughan et al.

(10) Patent No.: US 7,162,964 B2
(45) Date of Patent: Jan. 16, 2007

(54) TUFTING NEEDLE ASSEMBLY

(75) Inventors: William N. Vaughan, Cartersville, GA (US); Barrett Morton, Cartersville, GA (US); James E. Jarrett, Cartersville, GA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 10/899,884

(22) Filed: Jul. 27, 2004

(65) Prior Publication Data

US 2005/0005829 A1 Jan. 13, 2005

Related U.S. Application Data

(63) Continuation of application No. 10/138,796, filed on May 3, 2002.

(60) Provisional application No. 60/288,486, filed on May 3, 2001.

(51) Int. Cl.
*D05C 15/12* (2006.01)
*D05C 11/02* (2006.01)

(52) U.S. Cl. ..... 112/80.4

(58) Field of Classification Search ..... 112/80.4, 112/80.41, 80.45, 221, 222, 226, 227
See application file for complete search history.

(56) References Cited

U.S. PATENT DOCUMENTS

| | | | | | |
|---|---|---|---|---|---|
| 4,014,278 | A | * | 3/1977 | Jolley et al. | 112/226 |
| 4,067,270 | A | * | 1/1978 | Short | 112/80.45 |
| 4,350,106 | A | * | 9/1982 | Hash | 112/410 |
| 4,398,479 | A | * | 8/1983 | Czelusniak, Jr. | 112/80.41 |
| 4,658,739 | A | * | 4/1987 | Watkins | 112/80.3 |
| 4,662,291 | A | * | 5/1987 | Bardsley | 112/80.41 |
| 6,014,937 | A | * | 1/2000 | Lovelady | 112/80.41 |

FOREIGN PATENT DOCUMENTS

WO WO 97/05320 * 2/1997

* cited by examiner

*Primary Examiner*—Ismael Izaguirre
(74) *Attorney, Agent, or Firm*—Needle & Rosenberg, P.C.

(57) ABSTRACT

A tufting needle assembly for use with a tufting machine is disclosed that comprises a first gauge block or needle bar having a first series of tufting needles disposed thereon. The respective tufting needles are spaced from one another along a first longitudinal axis extending in the lengthwise direction of the gauge block. At least one tufting needle is offset with respect to the first longitudinal axis and the adjacent ones of the tufting needles in the series of tufting needles in the range of from 0.005 to 0.100 inches. The tufting needle assembly further comprises a second series of spaced tufting needles extending along a second longitudinal axis spaced parallel to the first longitudinal axis.

66 Claims, 4 Drawing Sheets

TUFTING NEEDLE ASSEMBLY

CROSS-REFERENCE TO RELATED APPLICATIONS

This application is a continuation of U.S. application Ser. No. 10/138,796 filed May 3, 2002, which claims priority to provisional U.S. Patent Application Ser. No. 60/288,486, filed on May 3, 2001, in the United States Patent and Trademark Office, the provisions of which are incorporated fully herein by this reference.

BACKGROUND OF THE INVENTION

The invention relates in general to tufting machinery. More particularly, the invention relates to a tufting needle assembly featuring at least one offset tufting needle tip with respect to the needle tips or adjacent ones of a series of tufting needles disposed along a common longitudinal axis extending along a tufting machine needle bar, or a gauge block adapted for mounting on the needle bar.

FIELD OF THE INVENTION

A tufting machine produces the fibrous face of tufted articles, for example carpets, by tufting individual yarns through a primary backing material or substrate, as known. The tufting machine has a frame supporting at least one elongate needle bar on which at least one series of spaced tufting needles is disposed. A continuous web of backing material is continuously fed in a warp, i.e., a longitudinal or lengthwise, direction through the tufting machine during the tufting process. Each of the tufting needles is threaded with a suitable yarn to be tufted in the backing material, and the needles are passed together through the backing material by the reciprocating motion of the needle bar as the backing material is moved or carried past the needle bar during machine operation to form tufts in the "face" of the backing material. If so desired, and as known, the tufting machine may be provided with two spaced and parallel needle bars, each of which being provided with a separate series of spaced tufting needles.

The needle bar is driven through a suitable drive arrangement such that it is reciprocated vertically with respect to the backing material as it is passed beneath the needle bar during a continuous tufting operation. As appropriate, a looper and/or a knife may be placed on the face side of the backing material, in registry with each respective needle, so that loops or cut piles of tufted yarn are formed and remain in the backing material once the tufting needles are drawn by the needle bar back out of the backing material.

One known type of tufting machine is referred to as an "in-line" type of tufting machine, in which the respective tufting needles disposed on the needle bar are aligned with respect to one another along a common longitudinal axis. A problem in using this type of tufting machine, however, is that pattern and texture problems associated with the in-line, i.e., the spaced and parallel, rows of tufts formed by the tufting needles become quiet evident in the face of the tufted article. In the effort to address this problem, the use of laterally shifting needle bars in the weft direction of the tufting machine, i.e., laterally with respect to the length of the backing material, are employed in the effort to mask the tufted pattern or texture which would otherwise be seen in the tufted article. However, the problem persists of there being distinct tufted rows in the completed article, which rows will again be particularly visible in the tufted article where the tufting machine needle bar has only a single row of in-line needles, even if the needle bar is shifted laterally with respect to the web of backing material. Due to this problem, therefore, the needle bars of in-line tufting machines are rarely shifted, or are shifted only if highly textured, and thus more costly, yarns are used to hide the shift marks in the face of the tufted article.

It is also known to those skilled in the tufting arts to use two separate and "staggered" needle bars where a separate row of in-line tufting needles is disposed on each needle bar along separate longitudinal axes, respectively. In this arrangement, the longitudinal axes of the two respective rows of tufting needles are parallel to one another and are spaced apart a distance of at least one quarter of an inch. Additionally, the tufting needles of the two respective series of tufting needles will not be aligned with one another in the warp or lengthwise direction of the backing material as they alternate positions in the gauge of the tufting machine. For example, for a 1/10 gauge tufting machine, i.e., a tufting machine in which there are ten tufting needles per lengthwise inch of the needle bar(s), there will be two rows of 1/5 gauge needles, which together comprise a 1/10 gauge tufting machine. This configuration will break up some of the shift marks that will result from the use of in-line rows of tufting needles on the tufting machine, but this will in turn require that the corresponding loopers also be formed into two staggered 1/5 gauge in-line rows as well.

The shifting capability of this known type of tufting machine is thus limited to 1/5 of an inch. At certain stitch rates, however, the two separate rows of tufting needles will line up with one another, and the same phenomena results as if a single row of tufting needles is used such that there will be visible pattern and texture problems in the face of the tufted article. Another known problem with use of in-line rows of tufting needles is that as the tufting stitch rate drops, the in-line tufted row becomes more visible, and may therefore become visually objectionable for this reason.

What is needed, therefore, is an improved tufting needle assembly or configuration for use with either a single or dual needle bar tufting machine, and in which the needle bars may be laterally fixed or capable of being shifted, that will minimize the prospect of the aforementioned pattern, shift mark, and/or texture problems resulting in the tufted face of the article(s) being produced.

SUMMARY OF THE INVENTION

The present invention overcomes some of the design deficiencies of the known art by providing a tufting needle assembly, or configuration, for use with a tufting machine. The inventive tufting needle assembly, as described herein, provides for a staggered tuft implantation in a tufted backing material for achieving a better tufted surface texture which yields a more random tufted face, and minimizes shift marks in the face of the tufted articles so produced.

This is accomplished by providing the disclosed and inventive tufting needle assembly for use with a conventional tufting machine having a frame, a bed rail supported on the frame, a continuous web of backing material passed over the bed rail and through the tufting machine, and at least one drive roll for moving the web of backing material through the tufting machine. At least one elongate needle bar is positioned on the machine frame with respect to the backing material, and is provided with a drive system for reciprocating the needle bar toward and away from the backing material.

In a first embodiment, the tufting needle assembly comprises a first gauge block adapted to be mounted on the at least one needle bar, and a first series of gauge elements disposed on the gauge block and spaced from one another along a first longitudinal axis extending in the lengthwise direction of the gauge block. At least one gauge element within this first series of gauge elements is offset with respect to the first longitudinal axis and from adjacent ones of the gauge elements within said first series. If so desired, each gauge element may be offset with respect to the first longitudinal axis and from the adjacent ones of the gauge elements, and the adjacent ones of the gauge elements may be offset with respect to one another on opposite sides of the axis.

The at least one gauge element is offset from the first longitudinal axis in the range of from 0.005 to 0.100 inches, and may be offset from the adjacent ones of the gauge elements in the range of from 0.005 to 0.100 inches as well. The gauge elements within the first series of gauge elements may each comprise a tufting needle having an elongate needle shank with a proximal end affixed to the gauge block and a spaced distal end defining a needle tip.

Accordingly, the shank of at least one of the tufting needles may be offset with respect to the first longitudinal axis and the shanks of the adjacent ones of the tufting needles within said first series; or alternately, the needle tip of at least one of the tufting needles may be offset with respect to the first longitudinal axis and the needle tips of the adjacent ones of the tufting needles within said first series. For the at least one needle tip which is offset from the longitudinal axis, that needle tip may be formed eccentrically with respect to the needle tips of the adjacent ones of the tufting needles within the first series.

In a second embodiment, the tufting needle assembly comprises a second series of gauge elements (tufting needles) disposed on the first gauge block. The gauge elements within the second series are spaced from one another along a second longitudinal axis extending in the lengthwise direction of the gauge block, and the second longitudinal axis is spaced from and parallel to the first longitudinal axis, preferably in the range of from 0.20 to 0.25 inches.

In a first aspect, the gauge elements in the second series are aligned with respect to one another and extend linearly along the second longitudinal axis. In a second aspect, at least one gauge element of the second series is offset with respect to the second longitudinal axis and from the adjacent ones of the gauge elements within the second series. The shank of at least one of the tufting needles in the second series may be offset with respect to the second longitudinal axis and the shanks of the adjacent ones of the tufting needles within the second series, or the needle tip of at least one of the tufting needles in the second series may be offset with respect to the second longitudinal axis and the needle tips of the adjacent ones of the tufting needles within the second series.

In yet another embodiment, the invention comprises the first gauge block and the first series of tufting needles thereon, and a second elongate gauge block with a second series of gauge elements disposed thereon, the gauge elements within the second series being spaced from one another along a second longitudinal axis extending in the lengthwise direction of the second gauge block. The second longitudinal axis is spaced from and parallel to the first longitudinal axis of the first gauge block. In an additional aspect, at least one gauge element of the second series of gauge elements is offset with respect to the second longitudinal axis and from adjacent ones of the gauge elements within the second series, or the gauge elements within the second series may be linearly aligned with respect to one another along the second longitudinal axis.

The first and second axes and series of tufting needles, respectively, described above may therefore be formed on one or separate gauge blocks, or on one or separate needle bars, as desired. Also, the needle bar or bars may be constructed for lateral shifting, as known.

Accordingly, in at least the first embodiment of the present invention, having each row of needle tips staggered relative to other needle tips in series allows for a wider range of fabric constructions than tufting machines previously permitted. Additionally, constructed as described herein, there is much smaller risk of the two needle bars, and in particular the tufting needles thereon, falling in-line with one another, which, should this occur, might cause an objectionable linear weft direction visual effect in the tufted fibrous face of the primary backing. Still another advantage of the present invention is producing commercially-acceptable carpet having lower weight than a conventional carpet having an equally acceptable visual appearance.

It is, therefore, an object of the invention to provide an improved tufting needle assembly for use with the known types of tufting machines.

DETAILED DESCRIPTION

Figure 1:
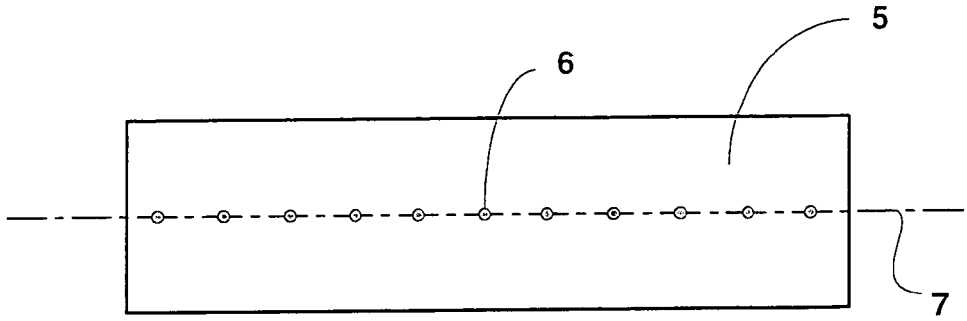
PRIOR ART FIG. 1
FIG. 1 is a schematic illustration of a first known type of tufting needle bar.
Figure 2:
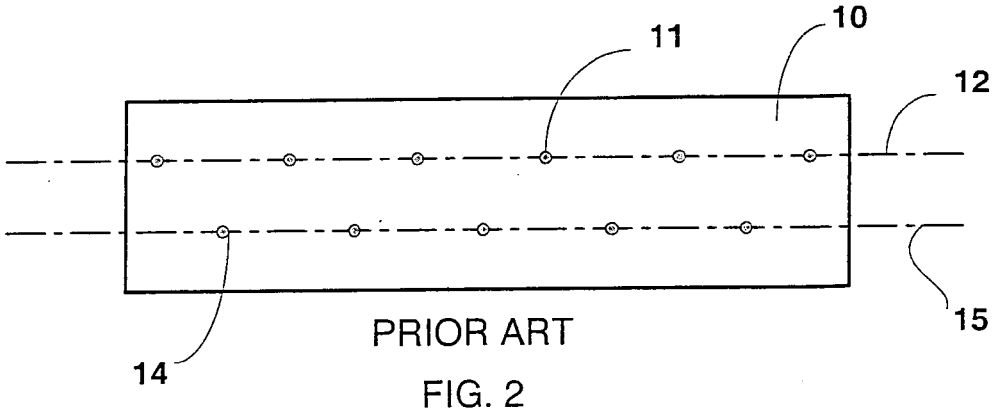
PRIOR ART FIG. 2
FIG. 2 is a schematic illustration of a second known type of tufting needle bar.
Figure 3:
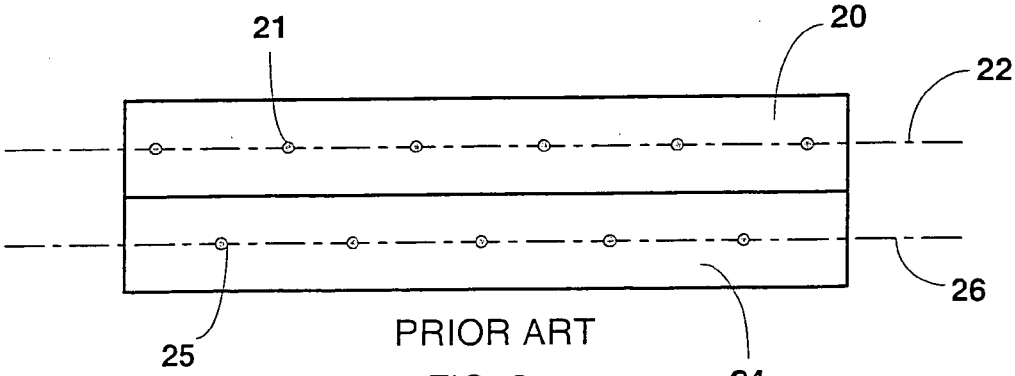
PRIOR ART FIG. 3
FIG. 3 is a schematic illustration of a third known type of tufting needle bar.

Referring now in detail to the drawings, in which like reference characters indicate like parts throughout he several views, three different known types of needle bar designs commonly used in the tufting process are illustrated in FIGS. 1–3. The simplest design is an in-line needle bar 5 of the type illustrated schematically in FIG. 1, in which each of the respective tufting needles 6 is positioned along a common longitudinal axis 7 extending in the lateral, or weft, direction of the tufting machine relative to the longitudinally (warp) moving backing material (not illustrated). The tufting needles are commonly spaced a tenth (1/10) of an inch apart from one another such that this configuration is known as a 1/10 gauge needle bar. Examples of in-line needle bars of this type are disclosed in U.S. Pat. Nos. 3,109,395 and 4,217,837, respectively, each of which is incorporated fully herein by this reference.

A second known type of needle bar design is a "staggered" needle bar as illustrated in FIG. 2. Here a needle bar 10 is provided having a first row or series of spaced tufting needles 11 extending along first longitudinal axis 12, and a second row or series of spaced tufting needles 14 extending along a second longitudinal axis 15. As shown, each of the respective tufting needles is staggered in the longitudinal, or warp, direction from the adjacent needle along either the first longitudinal axis 12 or the spaced and parallel second longitudinal axis 15. So constructed, the staggered needle bar forms two parallel rows of needles in which every other tufting needle is in a different row.

In the staggered construction illustrated in FIG. 2, there is typically a minimum quarter (1/4) of an inch distance or "stagger" between the two rows of tufting needles. Additionally, the tufting needles in each of the two separate rows of needles are spaced from one another laterally a distance of one fifth (1/5) of an inch in the weft direction, which results in the needle bar having a gauge of one tenth (1/10) of an inch, i.e., a ten gauge tufting machine. Examples of this type of a staggered needle bar construction are disclosed in U.S. Pat. Nos. 3,443,534; 4,067,270; 4,158,339; 4,448,137; 4,503,787; and 4,519,326, respectively, each of which is incorporated fully herein by this reference.

A third known type of tufting machine needle bar design is illustrated in FIG. 3, and is known to those skilled in the art as a graphic needle bar, a double needle bar, or a dual needle bar design. This needle bar design has two spaced and parallel needle bars rather than a single needle bar that forms either an in-line (FIG. 1) or the staggered (FIG. 2) needle bar design. The two separate needle bars of this third design, a first needle bar 20 and a second needle bar 24, together are similar to the staggered needle bar of FIG. 2 in that two separate series or rows of tufting needles 21, 25, respectively, are provided, only here there is only one row of tufting needles on each of the two needle bars. The tufting needles 21,25, are typically spaced laterally from one another a distance of one fifth (1/5) of an inch in the weft direction to again form a ten gauge needle bar/tufting machine. As illustrated, the tufting needles 21 lie along a first common longitudinal axis 22, and the tufting needles 25 lie along a second common longitudinal axis 26 spaced from and parallel to the first axis. The two axes 25, 26 will be spaced one quarter (1/4) of an inch from one another.

If the tufting machine on which the two needle bars 20, 21 are supported operates so that there is no relative (lateral) motion between the two needle bars, the needle bars of FIG. 3 will be used exactly the same as the staggered needle bar of FIG. 2. If, however, the two needle bars are independently shifted or moved laterally relative to each other in the weft direction of the backing material (not illustrated), significantly more tufting patterns can be formed. Examples of graphic needle bar designs are disclosed in U.S. Pat. Nos. 4,841,886; 5,058,518; 5,193,472; 5,224,434; 5,549,064; and 6,014,937, and in UK Patent Application GB 2,255,785, respectively, each of which is incorporated fully herein by this reference.

Figure 4:
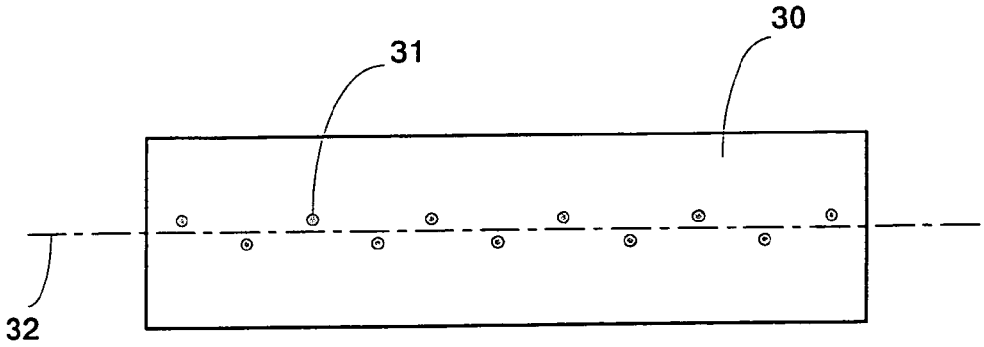
FIG. 4 is a schematic illustration of a first embodiment of the tufting needle assembly of the present invention.

Referring now to FIGS. 4–8, several embodiments of the inventive tufting needle assembly of this invention are illustrated. Referring first to FIG. 4, an elongate needle bar or gauge block 30 is illustrated. It is understood by those skilled in the art that either a needle bar or a gauge block can be used with the tufting needle assembly of this invention in that the tufting needles can be affixed directly to the needle bar, as known, or can be formed as a portion of a gauge block, the gauge block being constructed in known fashion for being suitably affixed to the needle bar. Accordingly, as used herein, the terms "gauge block" and "needle bar" are interchangeable for the purposes of describing the invention.

Referring still to FIG. 4, the needle bar 30 is provided with a first series of tufting needles 31, illustrated schematically. The tufting needles are spaced from one another in series along a longitudinal axis 32 extending in a lengthwise direction of the needle bar 30. As illustrated, each of the respective tufting needles 31 is offset with respect to the longitudinal axis 32, and is also offset with respect to each adjacent one of the tufting needles in series on the needle bar. Each tufting needle 31 will preferably be offset from its longitudinal axis, as well as from the adjacent ones of the tufting needles in series, in the range of from 0.005 to 0.100 inches, as described in greater detail, below.

Although each tufting needle 31 is shown as being offset with respect to the longitudinal axis and each adjacent tufting needle in series, it is anticipated that only one, any desired number, or each tufting needle may be offset in this manner, as desired. For example, if only selected tufting needles are offset (FIG. 10B), then a predetermined pattern may be fashioned by the tufting needle assembly such that when a tufted article is being produced on the tufting machine (not illustrated) a unique pattern will appear in the face of the tufted article.

When referring to the tufting needles 31 in FIG. 4, as well as to the term "tufting needles" throughout the specification, it is to be understood that the tufting needle element which is illustrated and described is the needle tip of the tufting needle. The needle tip may be offset with respect to the longitudinal axis of the series of tufting needles by positioning the shank of the tufting needle so that is offset with respect to the longitudinal axis of the tufting needles in series, or might be attained through an alternate tufting needle construction, as described in greater detail below, to form the offset tufting needle(s) in the series of tufting needles.

As illustrated in FIG. 4, therefore, the tufting needles 31 illustrated schematically represent the needle tips of the respective tufting needles, the needle tips being offset with respect to the longitudinal axis 32 and with respect to one another in the series of tufting needles. The needle bar or gauge block 30 will be constructed in known fashion. If a gauge block rather than a needle bar is used with the tufting needle assembly, the gauge block will be constructed in known fashion so that it can be suitably affixed to the tufting machine needle bar.

Figure 5:
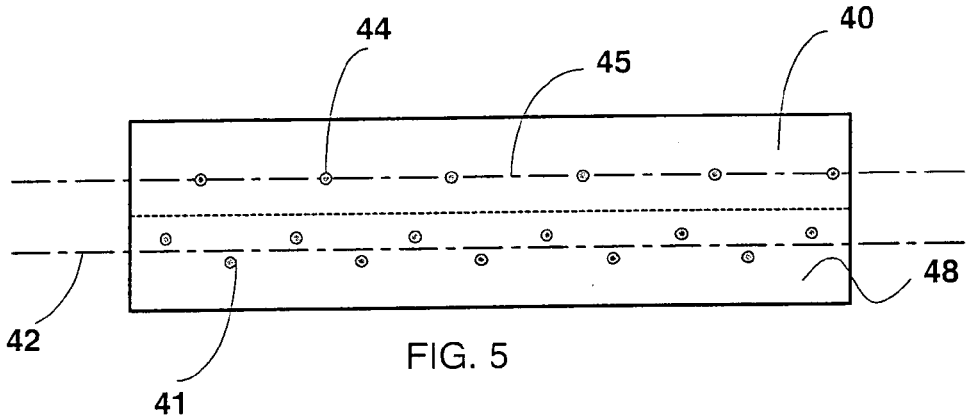
FIG. 5 is a schematic illustration of a second embodiment of the tufting needle assembly of the present invention.

A second embodiment of the invention is illustrated in FIG. 5. An elongate needle bar 40 is illustrated, having a first series of tufting needles 41 extending along a first longitudinal axis 42 in the lengthwise direction of the needle bar, and a second series of tufting needles 44 formed along a second longitudinal axis 45. The axis 45 is spaced from and parallel to the axis 42. As illustrated, the tufting needles of the second series of tufting needles are aligned with, i.e., are centered on, the longitudinal axis 45 along which the tufting needles extend. As shown in FIG. 5, the offset tufting needles 41 are of a first gauge, whereas the aligned tufting needles 44 of the second series are of a different gauge. For example, the tufting needles 41 may comprise a one-tenth (1/10) gauge series of tufting needles, whereas the tufting needles 44 may be formed as a one-fifth (1/5) gauge series of tufting needles.

Moreover, and as illustrated in FIG. 5, the needle bar or gauge block 40 can be fashioned as a first needle bar 40 and as a separate second needle bar 48, each of which is independent of the other, and which may be laterally shifted with respect to one another in known fashion. Regardless of whether a single needle bar 40 or a pair of needle bars 40, 48 is used, it is anticipated that the longitudinal axis 42 will preferably be spaced in the range of from two-tenths (0.2) to one quarter of an inch (0.25) from the second longitudinal axis 45.

As for the first series of offset tufting needles 31 illustrated in FIG. 4, it is anticipated that each of the offset tufting needles 41 in series will be offset from the longitudinal axis 42, as well as from adjacent ones of the tufting needles 41, in the range of from 0.005 to 0.100 inches. It is also possible, for example, that the tufting needles 41 may be offset in the range of from 0.005 to 0.100 inches from the longitudinal axis 42, and may also be offset in the range of from 0.005 to 0.100 inches from each adjacent tufting needle (needle tip) in series.

Figure 6:
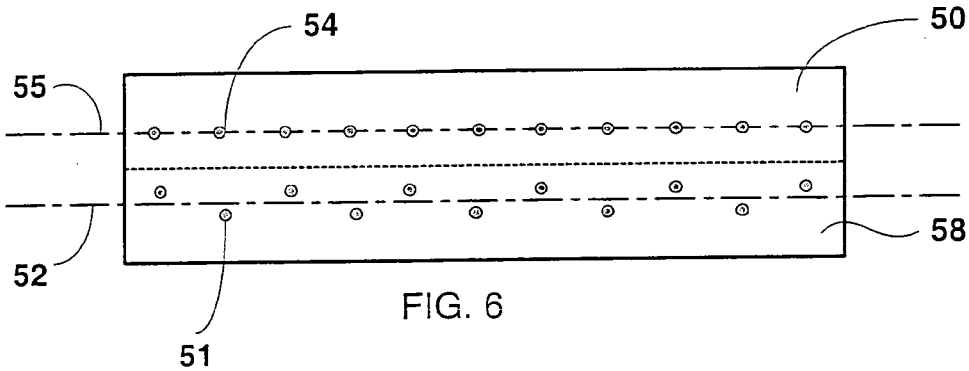
FIG. 6 is a schematic illustration of a third embodiment of the tufting needle assembly of the present invention.

A third embodiment of the tufting needle assembly of this invention is schematically illustrated in FIG. 6, in which an elongate needle bar 50 is illustrated having a first series of offset tufting needles 51 extending along a first longitudinal axis 52, and a second series of tufting needles 54 aligned with and extending along a second longitudinal axis 55 spaced from and parallel to the axis 52. The axis 52 will preferably be spaced from the axis 55 in the range of from 0.20 to 0.25 inches, although it is anticipated that this distance may be greater or lesser that this range if so desired. The tufting needles 51 will be offset with respect to the longitudinal axis 52 and the adjacent ones of the tufting needles in series in the range of from 0.005 to 0.100 inches.

As shown in FIG. 6, however, yet another different configuration is provided in which the series of offset tufting needles 51 is shown to have a first gauge and the aligned tufting needles 54 of the second series of tufting needles being formed to have the same gauge as the offset tufting needles, rather than being of a different gauge. What is contemplated by this invention, therefore, is that any combination of aligned and offset tufting needles can be used with the tufting needle assembly of this invention, of any desired gauge adapted for use with any known type of tufting machine, as well as with respect to the gauge of the loopers and/or knives of the tufting machine for forming Berber or a cut pile carpet, for example.

Still referring to FIG. 6, it is again anticipated that the disclosed invention may comprise a first needle bar 50 and a second spaced and parallel needle bar 58, such that the first series of tufting needles 51 is provided on a needle bar 58 and the second in-line series of tufting needles 54 is provided on a second and separate needle bar, each needle bar being capable of independent reciprocating motion, in known fashion, toward and away from a backing material (not illustrated) passed through the tufting machine, and which may also be laterally shifted with respect to one another.

Figure 7:
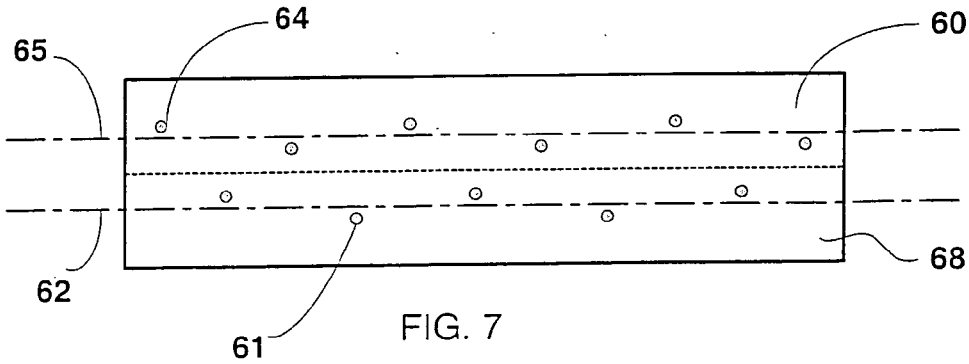
FIG. 7 is a schematic illustration of a fourth embodiment of the tufting needle assembly of the present invention.

Referring now to FIG. 7, a fourth embodiment of the inventive tufting needle assembly of this invention is disclosed. An elongate needle block 60 is illustrated having a first series of tufting needles 61 offset with respect to a longitudinal axis 62 extending the length of the needle bar. A second offset series of tufting needles 64 is also provided which extend along a second longitudinal axis 65, the tufting needles 64 being offset with respect to the second longitudinal axis. The second longitudinal axis extends parallel to the first axis and is preferably spaced therefrom in the range of from 0.20 to 0.25 inches. The offset tufting needles will be offset with respect to their respective longitudinal axes and the adjacent ones of the tufting needles in series in the range of from 0.005 to 0.100 inches.

Again, the needle bar 60 can comprise a single needle bar, or can comprise a pair of needle bars 60, 68, as schematically illustrated in FIG. 7, such that each needle bar can be independently shifted with respect to the another. A unique feature of the tufting needle assembly of this invention, however, is also illustrated in FIG. 7.

If the needle bar 60 is operated to shift in known fashion, and a series of loopers (not illustrated), one for each tufting needle, is provided, the disclosed needle bar is capable of shifting the normal gauge configuration of the loopers in the machine. For example, assuming that each series of tufting needles 61, 64, respectively, is disposed on a single needle bar 60, and each comprises an offset one-fifth (1/5) gauge series of tufting needles yielding a nominal one-tenth (1/10) gauge tufting machine, and where the tufting machine has two corresponding one-fifth (1/5) gauge series of in-line loopers (not illustrated), one for each series of tufting needles, the needle bar can be shifted in any increment of one-tenth (1/10) or two-tenths of an inch (2/10), respectively, i.e., in the gauge of the machine, which will result in the respective tufting needles 61, 64, being aligned with a respective one of the loopers provided as a part of the tufting machine.

Where a first needle bar 60 and a separate second needle bar 68 are provided, and where one of each series of tufting needles 61, 64, respectively, lies along a separate needle bar 60, 68, respectively, and if each series of tufting needles once again comprises an offset one-fifth (1/5) gauge series of tufting needles for a nominal one-tenth (1/10) gauge tufting machine, and if the tufting machine has two corresponding one-tenth (1/10) gauge series of in-line loopers (not illustrated), one for each series of tufting needles, the two needle bars can be shifted in any increment of one-tenth of an inch (1/10) of an inch, i.e., in the gauge of the tufting machine, which will once again result in a respective tufting needle 61, 64 being aligned with a respective one of the loopers provided as a part of the tufting machine. Thus, the two needle bar configuration of FIG. 7 and the respective series of tufting needles are also capable of being shifted in the normal tufting machine gauge configuration.

Figure 8:
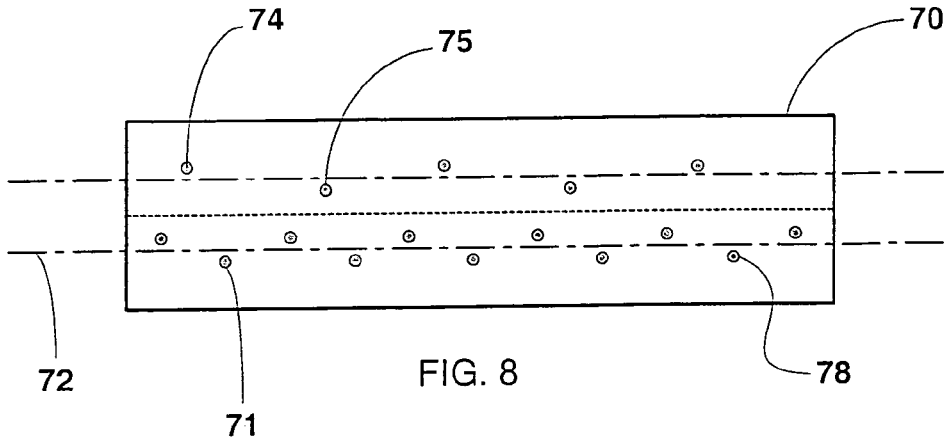
FIG. 8 is a schematic illustration of a fifth embodiment of the tufting needle assembly of the present invention

Yet another embodiment of the tufting needle assembly of this invention is schematically illustrated in FIG. 8. As shown, an elongate needle bar 70 is provided having a first series of tufting needles 71 offset with respect to a longitudinal axis 72 extending the length of the needle bar. A second series of tufting needles 74 is provided in which the tufting needles are offset with respect to a second longitudinal axis 75 also extending the length of the needle bar. As with the prior embodiments of the invention described above, the longitudinal axis 72 is spaced from and parallel to the longitudinal axis 75, preferably in the range of from 0.20 to 0.25 inches. Additionally, each one of the tufting needles 71, 74, respectively, is offset with respect to its respective longitudinal axis 72, 75 and the adjacent ones of the tufting needles in series in the range of from 0.005 to 0.100 inches.

Still referring to FIG. 8, the first series of tufting needles 71 may form, for example, a one-eighth (⅛) gauge needle bar or series of tufting needles, and the second series of tufting needles 74 may be formed as a one-fourth (¼) gauge needle bar or series of tufting needles, with both of the respective series of tufting needles being formed on a single needle bar, or on separate spaced and parallel needle bars 70, 78, in the fashion described above. Moreover, although the second series of tufting needles 74 is shown being offset with respect to the longitudinal axis 75, the tufting needles can be aligned with the longitudinal axis, as shown, for example, for the second series of tufting needles in each of FIGS. 5 and 6.

Figures 9A, 9B, 9C:
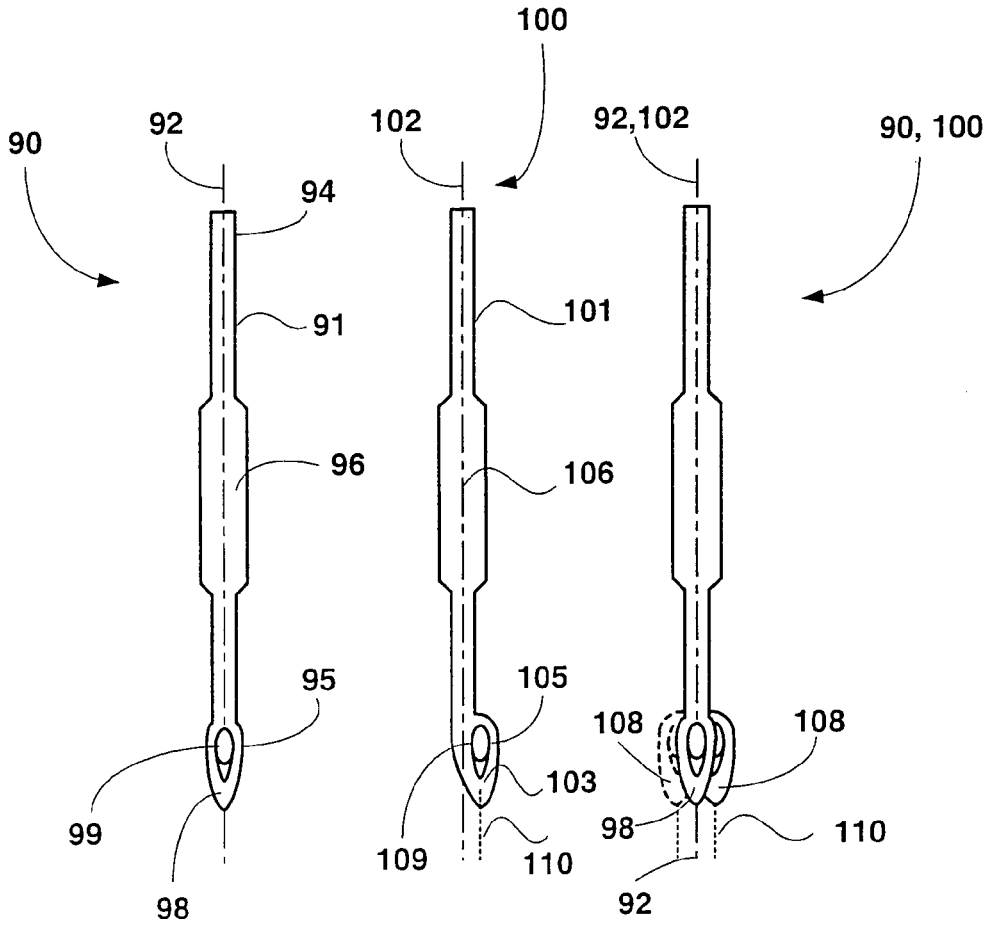
FIG. 9A is an illustration of a conventional tufting needle.
FIG. 9B is an illustration of a tufting needle having an eccentric needle tip offset with respect to the axial centerline of the tufting needle.
FIG. 9C is an illustration of the tufting needle of FIG. 9A with the eccentric tufting needle of FIG. 9B spaced therefrom, with the shanks of the respective tufting needles linearly aligned with one another and with their respective needle tips being offset from one another.

A conventional tufting needle 90 is illustrated in FIG. 9A. As known, the tufting needle is comprised of an elongate shank 91 formed along and about an axial center line 92. The tufting needle has a proximal end 94 which is adapted to be embedded or otherwise affixed within a needle bar or gauge block, in known fashion, and a spaced distal end 95. A planar blade is defined along the length of the shank intermediate its proximal and distal ends, and forms, in known fashion, a target area defining a pick up area such that the bill of an appropriate looper (not illustrated) may slidably pass over the target area and along the pickup area for receiving a yarn (not illustrated) threaded through the tufting needle, in known fashion. Still referring to FIG. 10A, a needle tip 98 is defined at the distal end of the tufting needle, in which an eyelet 99 is defined for receiving a tufting yarn (not illustrated) therethrough.

Figure 10A:
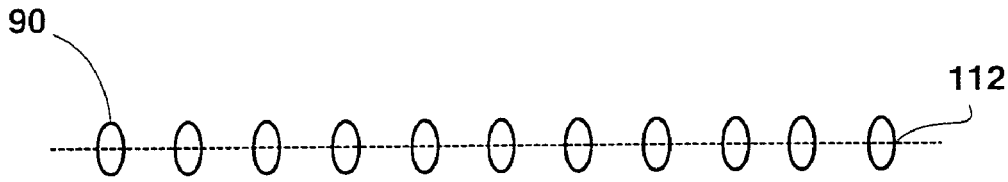
FIG. 10A is a schematic illustration of a first series of spaced tufting needles extending in the lengthwise direction of a common longitudinal axis with the respective tufting needle tips being aligned with respect to one another and the axis.
Figure 10B:
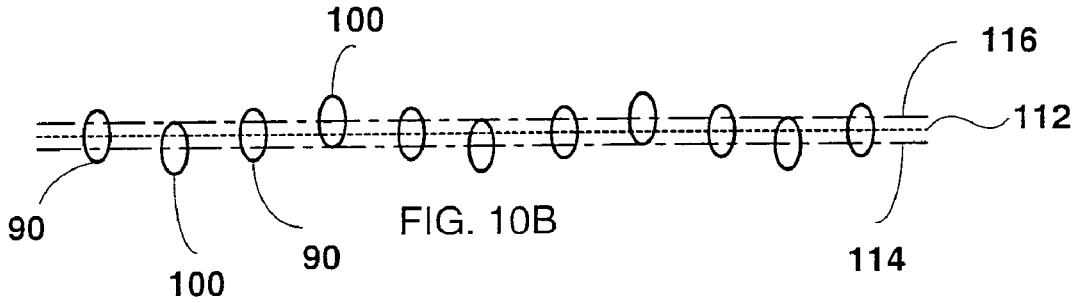
FIG. 10B is a schematic illustration of a second series of spaced tufting needles extending in the lengthwise direction of a common longitudinal axis with the needle tips of every other tufting needle being offset with respect to the adjacent tufting needles and the longitudinal axis.

An eccentric tufting needle, i.e., a tufting needle having an eccentric needle tip, for use with this invention is illustrated in FIG. 10B. The eccentric tufting needle 100 is provided with an elongate needle shank 101 formed along and about a central axis 102. The needle shank includes a proximal end 104 adapted for being affixed or embedded within an appropriate needle bar or gauge block, as known, and a spaced distal end 105. The tufting needle 100 also includes a blade 106 defining a target area and a pick up area, respectively, as described for the tufting needle 90, for allowing the slidable engagement of the bill of a looper (not illustrated) thereover when engaging a tufting yarn threaded on the needle.

Unlike the conventional tufting needle 90, as illustrated in FIG. 10A, however, the eccentric tufting needle 100 has an eccentric needle tip 108 defined at its distal end. The eccentric needle tip includes an eyelet 109 which extends along an offset axis 110 which is spaced from and parallel to the axial center line 102 of the tufting needle. The distance between the axial center line 102 and the offset axis 110 of the eyelet 109 defines the degree of eccentricity or offset of the needle tip. The degree of eccentricity, i.e., the offset axis 110, with respect to the axial center line 102 of the eccentric tufting needle 100 will preferably be in the range of from 0.005 to 0.100 inches, or may comprise any other offset, as desired.

Figure 10C:
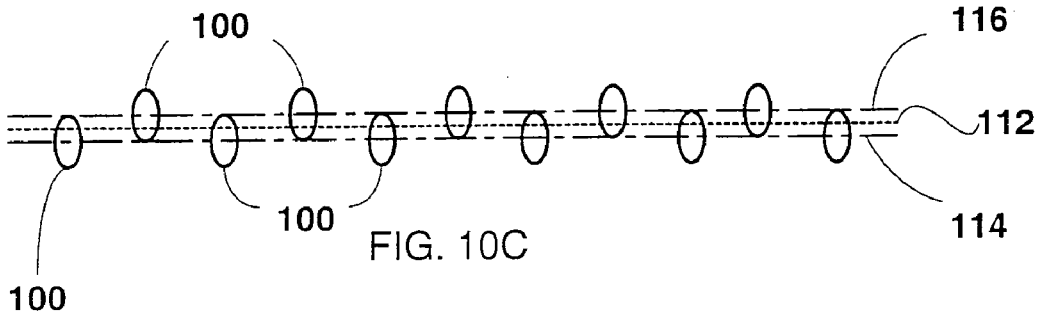
FIG. 10C is a schematic illustration of a third series of spaced tufting needles extending in the lengthwise direction of a common longitudinal axis with the needle tips of each tufting needle being offset with respect to one another and the longitudinal axis.

Referring now to FIGS. 10A–C, and in particular FIG. 10A, a series of conventional tufting needles 90 is illustrated in which each one of the tufting needles, and in particular the axial center line 92 thereof (FIG. 9A) is embedded within a suitable needle bar or gauge block, extend in series along a common longitudinal axis 112 such that the axis passes through the axial center line of each respective tufting needle. This is a known type of tufting needle configuration. It is also possible, however, that by using the conventional tufting needles and physically offsetting them (the axial center lines thereof) from the common longitudinal axis, as well as from one another, that the offset tufting needle arrangements of FIGS. 10B and C could result.

In heretofore unknown fashion, however, rather than using offset ones of the conventional tufting needles 90, the eccentric tufting needles 100 (FIG. 9B) may be used alone (FIG. 10C), or in combination with the conventional tufting needles (FIG. 10B) to arrive at an offset tufting needle assembly as described for the several embodiments of the invention above.

Referring first to FIG. 10B, here the series of offset tufting needles is comprised of alternating ones of the conventional tufting needles 90 of which their respective axial center lines 92 (FIG. 9A) are physically aligned with the common longitudinal axis 112, and alternating ones of the eccentric tufting needles 100 of FIG. 9B, in which the respective shanks (the axial center lines 102) are also aligned with the common longitudinal axis 112 of the series of tufting needles. However, due to the eccentric nature of the respective needle tips 108 of the eccentric tufting needles, the eyelets 109 thereof will be offset with respect to the common longitudinal axis of the tufting needle series. This can be accomplished by turning every other, or any desired combination, of eccentric tufting needles 180 degrees with respect to one another, as shown in FIG. 10B so that the eyelets, and in particular the respective axes 110 thereof, lie along one of the two offset axes 114 and 116 so formed.

FIG. 10C illustrates yet another possible series of offset tufting needles, in which only a series of the eccentric tufting needles 100 is employed. The respective axial center lines 102 (FIG. 9B) of the tufting needles are aligned with the common longitudinal axis 112, and every other one of the tufting needles 100 is turned 180 degrees with respect to one another such that the offset/eccentricity of the respective needle tips lie along either one of the two offset axes 114, 116, respectively. It is also possible, however, as suggested above, that the offset needle configuration illustrated in FIG. 10C could also be constructed by using the conventional tufting needles 90 so that every other one of the tufting needles is aligned with either one of the two offset axes 114, 116, respectively.

Another unique feature of the invention is that regardless of which offset needle configuration illustrated in FIGS. 10B–C is used, the blades of the respective tufting needles will be aligned with respect to one another. For example, and referring to FIG. 10B in which every other tufting needle comprises a conventional tufting needle or an eccentric tufting needle, and to FIG. 10C in which every needle is an eccentric tufting needle, when looking at the tufting needles in the elevational view of FIG. 9C it is seen that the tufting needles, and in particular the axial center lines 92, 102, thereof are aligned with one another, although the needle tips 98, 108 may be offset with respect to one another. Accordingly, despite the degree of eccentricity or offset at the needle tips of the respective tufting needles used, as the axial center lines of the tufting needles extend along a common longitudinal axis, the needle blades 96,106 will be aligned with the common longitudinal axis 112 so that conventional loopers may be used with either one or both of the tufting needles.

The embodiments of the tufting needle assembly illustrated in FIGS. 10A–C are not limited to conventional and eccentric tufting needles, but to any tufting needles that are fashioned to allow their respective needle tips to be offset when their respective needle shanks are linearly aligned along a common longitudinal axis. Thus, the same types of needles are used and their shafts are linearly aligned, but the needles are oriented so that the tips are offset relative to each other.

As one skilled in the art will appreciate, the term "needle tip" is used herein to describe that portion of the tufting needle that penetrates into and through the backing material during the tufting process. Toward that end, the term "needle tip" thus also refers to the location that the yarn is tufted into the backing material and, within the scope of the present invention, the yarns are offset from one another when viewed in the weftwise (lateral) direction of the tufted articles so produced. Accordingly, as selected tufting needle tips are offset with respect to one another, the yarns threaded through those tufting needles are tufted into the backing material in a non-linear arrangement when viewed in the weft direction of the tufted article.

As one skilled in the art will also appreciate, the present invention can thus comprise a combination of the two disclosed aspects of the inventive tufting needle assembly in which the shanks of the needles are aligned with or offset from the longitudinal axis of the series of tufting needles on the gauge block or needle bar, and may include different types of tufting needles beyond those illustrated. For example, some eccentric point tufting needles may be used in conjunction with the tufting needles having offset shanks in order to vary the spacing between the tips of the needles from that which would exist if only conventional tufting needles were used in the respective series of tufting needles.

Regardless of the embodiment of the present invention, preferably the tips of every other tufting needle (or each alternating tufting needle) on a needle bar are offset so that the needle tips form a serrated pattern in plan view, as illustrated in FIGS. 10B and C. The anticipated range for offsetting the respective needle tips from the longitudinal axis along which the tufting needles are disposed, as well as from adjacent ones of the tufting needles, is between 0.005 and 0.100 inches. A first preferred range lies between 0.010 and 0.080 inches, a second preferred range lies between 0.015 and 0.060 inches, and a third and more preferred range lies between 0.020 and 0.040 inches. Within these preferred offset ranges, it is specifically contemplated offsetting the alternating needle tips on the gauge block or needle bar at distances of 0.020, 0.025, 0.030, 0.035, 0.0400, 0.0450, 0.0500, 0.0550, 0.0600, 0.0650, and 0.0700 inches.

Also, it is also contemplated having other offset tufting needle arrangements. For example, the scope of the present invention encompasses a design in which the tip of every third needle on the needle bar/gauge block is offset, i.e., a repeating pattern of two adjacent needle tips being in-line and every third needle tip being offset relative to those two in-line needle tips. It is further contemplated that the offset occurs at different intervals on the same needle bar. For example, in one design, the second needle tip can be offset a distance of 0.020 inches relative to the two adjacent needle tips, the fourth needle tip can be offset a distance of 0.040 inches relative to the two adjacent needle tips, and the sixth needle tip can be offset at a distance of 0.020 inches or yet another interval relative to the two adjacent needle tips. As one skilled in the art will appreciate, these designs are exemplary and a great many other needle tip/pattern variations are contemplated within the scope of the present invention.

As those skilled in the art are also aware, the articles tufted on the tufting machines of the prior art having in-line rows of tufting needles/needle tips result in the aforementioned pattern, shift mark, and/or texture problems becoming visually apparent in the tufted articles produced as the stitch rate of a tufted fabric decreases. With each individual row of needle tips being offset in the present invention, the tufted rows of yarn advantageously do not line up in the weft direction of the tufted article, even as the stitch rate is reduced. The present invention thus allows for reduced stitch rates, lower tufted face weights with superior aesthetics, and increased tufting throughput than is possible using prior art systems and needle bars. These advantages are achieved regardless whether the needle bar is laterally fixed in position with respect tot the backing material or is shifted during the tufting process.

One skilled in the art will further appreciate another advantage of the present invention which is that the disclosed tufting needle assembly may be easily incorporated into existing tufting machinery. That is, regardless of whether a single or a double needle bar arrangement is used, or whether the tufting needles are affixed to a gauge block which is in turn affixed to the needle bar(s), the offset relationship between the tufting needle tips is relatively small so that no adjustments are likely necessary to the tufting machine. For example, it is anticipated that the loopers of the tufting machine will not need to be replaced, and will most likely require little or no adjustment when being used on the gauge block(s)/needle bar(s) of the present invention.

Although several embodiments of the invention have been disclosed in the foregoing specification, it is understood by those skilled in the art that many modifications and other embodiments in the invention will come to mind to which the invention pertains, having the benefit of the teaching presented in the foregoing description and the associated drawings. It is thus understood that the invention is not limited to the specific embodiments disclosed hereinabove, and that many modifications and other embodiments are intended to be included within the scope of the invention. Moreover, although specific terms are employed herein, they are used only in a generic and descriptive sense, and not for the purposes of limiting the described invention, and the words "a," "and," or "the" as they appear hereinabove may mean one or more, depending upon the context in which the words are used.

We claim:

1. A tufting needle assembly for use with a tufting machine, the tufting machine having a frame, at least one elongate and reciprocating needle bar supported on the frame and adapted for a lateral shifting motion with respect to the frame, comprising:

a first gauge block adapted to be mounted on the at least one needle bar;

a first series of gauge elements disposed on the gauge block, the gauge elements within said first series being spaced from one another along a first longitudinal axis extending in the lengthwise direction of the gauge block;

a first series of in-line loopers of a predetermined tufting machine gauge positioned with respect to the at least one needle bar, and a means for aligning each respective gauge element of the first series of gauge elements with a respective one of the loopers of the first series of in-line loopers, wherein at least one gauge element within said first series is offset with respect to the first longitudinal axis and from adjacent ones of the gauge elements within said first series in the range of from about 0.005 to 0.100 inches.

2. The tufting needle assembly of claim 1, wherein each gauge element within said first series is offset with respect to the first longitudinal axis and from the adjacent ones of the gauge elements within said first series.

3. The tufting needle assembly of claim 2, wherein the adjacent ones of the gauge elements of said first series are offset with respect to one another on opposite sides of said axis.

4. The tufting needle assembly of claim 1, wherein selected ones of the gauge elements within said first series are offset with respect to the first longitudinal axis to form a predetermined pattern of gauge elements.

5. The tufting needle assembly of claim 1, wherein the gauge elements within the first series of gauge elements each comprises a tufting needle having an elongate needle shank with a proximal end affixed to the gauge block and a spaced distal end defining a needle tip.

6. The tufting needle assembly of claim 5, wherein the shank of at least one of the tufting needles in said first series is offset with respect to the first longitudinal axis.

7. The tufting needle assembly of claim 5, wherein the needle tip of at least one of the tufting needles in said first series is offset with respect to the first longitudinal axis.

8. The tufting needle assembly of claim 7, wherein the shanks of the tufting needles in said first series are aligned with respect to one another and extend linearly along the first longitudinal axis.

9. The tufting needle assembly of claim 7, wherein the at least one offset needle tip of the tufting needles in said first series is formed eccentrically with respect to the needle tips of the adjacent ones of the tufting needles within said first series.

10. The tufting needle assembly of claim 1, further comprising a second series of gauge elements disposed on the first gauge block, the gauge elements within said second series being spaced from one another along a second longitudinal axis extending in the lengthwise direction of the gauge block, the second longitudinal axis being spaced from and parallel to the first longitudinal axis.

11. The tufting needle assembly of claim 10, wherein the second longitudinal axis is spaced from the first longitudinal axis in the range of from about 0.20 to 0.25 inches.

12. The tufting needle assembly of claim 10, wherein the gauge elements within said second series are aligned with respect to one another and extend linearly along the second longitudinal axis.

13. The tufting needle assembly of claim 10, wherein at least one gauge element within said second series is offset with respect to the second longitudinal axis and from the adjacent ones of the gauge elements within said second series.

14. The tufting needle assembly of claim 13, wherein said at least one offset gauge element is offset from the second longitudinal axis in the range of from about 0.005 to 0.100 inches.

15. The tufting needle assembly of claim 10, wherein each of the gauge elements within said second series comprises a tufting needle having an elongate needle shank with a proximal end affixed to the gauge block and a spaced distal end defining a needle tip.

16. The tufting needle assembly of claim 15, wherein the shank of at least one of the tufting needles in said second series is offset with respect to the second longitudinal axis.

17. The tufting needle assembly of claim 15, wherein the needle tip of at least one of the tufting needles in said second series is offset with respect to the second longitudinal axis.

18. The tufting needle assembly of claim 17, wherein the shanks of the tufting needles within said second series are aligned with respect to one another and extend linearly along the second longitudinal axis.

19. The tufting needle assembly of claim 10, wherein the gauge elements of said first series are spaced from one another along said first axis to define a predetermined needle gauge, and wherein the gauge elements of said second series are laterally offset with respect to the gauge elements of said first series and are also spaced from one another in said predetermined needle gauge, the needle gauges of the first and the second series of gauge elements, respectively, when combined equaling the predetermined gauge of the tufting machine.

20. The tufting needle assembly of claim 19, further comprising:

a second series of in-line loopers of a predetermined tufting machine gauge positioned with respect to each needle bar; and a means for aligning each respective gauge elements of the second series of gauge elements with a respective one of the loopers of the second series of in-line loopers, wherein as the needle bar of the tufting machine is laterally shifted in the predetermined gauge of the tufting machine, the respective gauge elements of said first and said second series of gauge elements will be aligned with a corresponding one of the in-line loopers spaced in the predetermined gauge of the tufting machine.

21. The tufting needle assembly of claim 1, further comprising:

a second elongate gauge block; and a second series of gauge elements disposed on the second gauge block, the gauge elements within said second series being spaced from one another along a second longitudinal axis extending in the lengthwise direction of the second gauge block;

the second longitudinal axis being spaced from and parallel to the first longitudinal axis of the first gauge block.

22. The tufting needle assembly of claim 21, wherein at least one gauge element of the second series of gauge elements is offset with respect to the second longitudinal axis and from adjacent ones of the gauge elements within said second series.

23. The tufting needle assembly of claim 21, wherein the gauge elements within said second series are linearly aligned with respect to one another along the second longitudinal axis.

24. The tufting needle assembly of claim 21, wherein the second gauge block is adapted to be mounted on a second needle bar spaced from and parallel to the first needle bar.

25. The tufting needle assembly of claim 24, the gauge elements of said first series being spaced from one another along said first axis to define a predetermined needle gauge, the gauge elements of said second series being laterally offset with respect to the gauge elements of said first series and being spaced from one another in said predetermined needle gauge, the needle gauges of the first and the second series of gauge elements, respectively, when combined equaling the predetermined gauge of the tufting machine.

26. The tufting needle assembly of claim 25, further comprising:

a second series of in-line loopers of a predetermined tufting machine gauge positioned with respect to each needle bar; and a means for aligning each respective gauge elements of the second series of gauge elements with a respective one of the loopers of the second series of in-line loopers, wherein as the first and second needle bars of the tufting machine are laterally shifted in the predetermined gauge of the tufting machine, the respective gauge elements of said first and said second series of gauge elements will be aligned with a corresponding one of the in-line loopers spaced in the predetermined gauge of the tufting machine.

27. A tufting needle assembly for use with a tufting machine, said tufting needle assembly comprising:

a first elongate needle bar;

a first series of spaced tufting needles disposed on the needle bar, the tufting needles being spaced from one another along a first longitudinal axis extending in the lengthwise direction of the needle bar;

a first series of in-line loopers of a predetermined tufting machine gauge positioned with respect to the first needle bar, and a means for aligning each respective tufting needle of the first series of tufting needles with a respective one of the loopers of the first series of in-line loopers, wherein each tufting needle of said first series of spaced tufting needles comprises an elongate needle shank having a proximal end affixed to the needle bar and a spaced distal end defining a needle tip, and wherein at least one tufting needle within said first series is offset with respect to the first longitudinal axis and from each adjacent one of the tufting needles within said first series in the range of from about 0.005 to 0.100 inches.

28. The tufting needle assembly of claim 27, wherein the shank of at least one of the tufting needles of the first series of tufting needles is offset with respect to the first longitudinal axis and the shanks of the adjacent ones of the tufting needles of the first series of tufting needles.

29. The tufting needle assembly of claim 27, wherein the needle tip of at least one of the tufting needles of the first series of tufting needles is offset with respect to the first longitudinal axis and the needle tips of the adjacent ones of the tufting needles of the first series of gauge elements.

30. The tufting needle assembly of claim 29, wherein the needle tip of the least one tufting needle of the first series of tufting needles is offset from the first longitudinal axis and the needle tips of the adjacent ones of the tufting needles within said first series in the range of from about 0.005 to 0.100 inches.

31. The tufting needle assembly of claim 27, further comprising a second series of tufting needles affixed to the first needle bar, the tufting needles within said second series being spaced from one another along a second longitudinal axis extending in the lengthwise direction of the needle bar, the second longitudinal axis being spaced from and parallel to said first longitudinal axis.

32. The tufting needle assembly of claim 31, wherein the second longitudinal axis is spaced from the first longitudinal axis in the range of from about 0.20 to 0.25 inches.

33. The tufting needle assembly of claim 31, wherein the tufting needles within said second series are aligned with respect to one another and extend linearly along the second longitudinal axis.

34. The tufting needle assembly of claim 31, wherein at least one tufling needle within said second series is offset with respect to the second longitudinal axis and from the adjacent ones of the tufting needles within the second series of tufting needles.

35. The tufting needle assembly of claim 34, wherein the at least one tufting needle within said second series is offset from the second longitudinal axis and the adjacent ones of the tufting needles within said second series in the range of from about 0.005 to 0.100 inches.

36. The tufting needle assembly of claim 27, further comprising:

a second elongate needle bar;

a second series of spaced tufting needles disposed on the second needle bar, the tufting needles within said second series being spaced from one another along a second longitudinal axis extending in the lengthwise direction of the second needle bar, the second longitudinal axis being spaced from and parallel to the first longitudinal axis;

a second series of in-line loopers of a predetermined tufting machine gauge positioned with respect to the second needle bar; and a means for aligning each respective tufting needle of the second series of tufting needles with a respective one of the loopers of the second series of in-line loopers, wherein each tufting needle of said second series of tufting needles comprises an elongate needle shank having a proximal end affixed to the first needle bar and a spaced distal end defining a needle tip.

37. The tufting needle assembly of claim 36, wherein at least one tufling needle within said second series is offset with respect to the second longitudinal axis and from each adjacent one of the tufting needles within said second series.

38. The tufting needle assembly of claim 36, wherein the tufting needles within said second series are aligned with respect to one another and extend linearly along the second longitudinal axis.

39. A tufting needle assembly for use with a tufting machine, said tufting needle assembly comprising:

a first elongate needle bar;

a first series of spaced tufting needles disposed on the needle bar and extending in the lengthwise direction thereof along a first longitudinal axis, each tufting needle comprising an elongate needle shank having a proximal end carried on the needle bar and a spaced distal end defining a needle tip;

a first series of in-line loopers of a predetermined tufting machine gauge positioned with respect to the first needle bar, and a means for aligning each respective tufting needle of the first series of tufting needles with a respective one of the loopers of the first series of in-line loopers, wherein the needle tip of at least one tufting needle within said first series is offset with respect to the first longitudinal axis of the needle bar in the range of from about 0.005 to 0.100 inches.

40. The tufting needle assembly of claim 39, wherein the shanks of the tufting needles of said first series are aligned with respect to one another and extend linearly along the first longitudinal axis.

41. The tufting needle assembly of claim 39, wherein the shank of the at least one tufting needle within said first series is offset with respect to the first longitudinal axis in the range of from about 0.005 to 0.100 inches.

42. The tufting needle assembly of claim 39, wherein the at least one offset needle tip of the tufting needles of said first series is formed eccentrically with respect to the needle tips of the adjacent ones of the tufting needles within said first series.

43. The tufting needle assembly of claim 39, wherein the needle tip of the least one tufting needle within said first series is offset from the first longitudinal axis and the needle tips of the adjacent ones of the tufting needles in said first series the in the range of from about 0.005 to 0.100 inches.

44. The tufting needle assembly of claim 39, further comprising:

a second series of tufting needles affixed to the first needle bar, the tufting needles within said second series being spaced from one another along a second longitudinal axis extending in the lengthwise direction of the needle bar, the second longitudinal axis being spaced from and parallel to said first longitudinal axis;

a second series of in-line loopers of a predetermined tufting machine gauge positioned with respect to the first needle bar; and a means for aligning each respective tufting needle of the second series of tufting needles with a respective one of the loopers of the second series of in-line loopers.

45. The tufting needle assembly of claim 44, wherein the second longitudinal axis is spaced from the first longitudinal axis in the range of from about 0.20 to 0.25 inches.

46. The tufting needle assembly of claim 44, wherein the needle tips of the tufting needles within said second series are aligned with respect to one another and extend linearly along the second longitudinal axis.

47. The tufting needle assembly of claim 44, wherein the needle tip of at least one tufting needle within said second series is offset with respect to the second longitudinal axis.

48. The tufting needle assembly of claim 47, wherein the needle tip of the at least one tufting needle within said second series is offset from the second longitudinal axis in the range of from about 0.005 to 0.100 inches.

49. A tufting needle assembly, comprising:

a mounting block;

a first series of tufting needles, each tufting needle of the first series having an elongate shank with a proximal end affixed to the mounting block and a distal end defining a needle tip, the tufting needles within said first series being spaced from one another along a first longitudinal axis extending in the lengthwise direction of the mounting block, wherein at least one tufting needle within said first series is offset with respect to the first longitudinal axis in the range of from about 0.005 to 0.100 inches;

a first series of in-line loopers of a predetermined tufting machine gauge positioned with respect to the mounting block, and a means for aligning each respective tufting needle of the first series of tufting needles with a respective one of the loopers of the first series of in-line loopers.

50. The tufting needle assembly of claim 49, further comprising:

a second series of tufting needles, each tufting needle of the second series having an elongate shank with a proximal end affixed to the mounting block and a distal end defining a needle tip, the tufting needles within said second series being spaced from one another along a second longitudinal axis extending in the lengthwise direction of the mounting block, the second longitudinal axis being spaced from and parallel to the first longitudinal axis;

a second series of in-line loopers of a predetermined tufting machine gauge positioned with respect to the mounting block; and a means for aligning each respective tufting needle of the second series of tufting needles with a respective one of the loopers of the second series of in-line loopers.

51. The tufting needle assembly of claim 50, wherein the second longitudinal axis is spaced from the first longitudinal axis in the range of from about 0.20 to 0.25 inches.

52. The tufting needle assembly of claim 50, wherein the tufting needles within said second series are aligned with respect to one another and extend linearly along the second longitudinal axis.

53. The tufting needle assembly of claim 50, wherein at least one tufting needle within said second series is offset with respect to the second longitudinal axis.

54. The tufting needle assembly of claim 53, wherein the at least one offset tufting needle within said second series is offset from the second longitudinal axis in the range of from about 0.005 to 0.100 inches.

55. The tufting needle assembly of claim 50, wherein the shank of at least one of the tufting needles within said second series is offset with respect to the second longitudinal axis.

56. The tufting needle assembly of claim 50, wherein the needle tip of at least one of the tufting needles within said second series is offset with respect to the second longitudinal axis.

57. The tufting needle assembly of claim 49, wherein each tufting needle within said first series is offset with respect to the first longitudinal axis and from the adjacent ones of the tufting needles of said first series.

58. The tufting needle assembly of claim 57, wherein the adjacent ones of the tufting needles of said first series are offset with respect to one another on opposite sides of the first longitudinal axis.

59. A tufling needle assembly for use with a tufting machine, the tufting machine having a frame, at least one elongate and reciprocating needle bar supported on the frame and adapted for a lateral shifting motion with respect to the frame, said tufting needle assembly comprising:

a first gauge block adapted to be mounted on the at least one needle bar;

a first series of gauge elements disposed on the gauge block, the gauge elements within said first series being spaced from one another along a first longitudinal axis extending in the lengthwise direction of the gauge block, wherein at least one gauge element within said first series is offset with respect to the first longitudinal axis and from adjacent ones of the gauge elements within said first series in the range of from about 0.005 to 0.100 inches;

a second series of gauge elements disposed on the first gauge block, the gauge elements within said second series being spaced from one another along a second longitudinal axis extending in the lengthwise direction of the gauge block, the second longitudinal axis being spaced from and parallel to the first longitudinal axis;

a first series of in-line loopers of a predetermined tufting machine gauge positioned with respect to the at least one needle bar, and a means for aligning each respective gauge element of the first series of gauge elements with a respective one of the loopers of the first series of in-line loopers.

60. The tufting needle assembly of claim 59, wherein each of the gauge elements within said second series comprises a tufting needle having an elongate needle shank with a proximal end affixed to the gauge block and a spaced distal end defining a needle tip, wherein the needle tip of at least one of the tufting needles in said second series is offset with respect to the second longitudinal axis, and wherein the shanks of the tufting needles within said second series are aligned with respect to one another and extend linearly along the second longitudinal axis.

61. A tufting needle assembly for use with a tufting machine, the tufting machine having a frame, at least one elongate and reciprocating needle bar supported on the frame and adapted for a lateral shifting motion with respect to the frame, and a series of loopers of a predetermined tufting machine gauge, one series of loopers for each needle bar, positioned with respect to the needle bar, said tufting needle assembly comprising:

a first gauge block adapted to be mounted on the at least one needle bar;

a first series of gauge elements disposed on the gauge block, the gauge elements within said first series being spaced from one another along a first longitudinal axis extending in the lengthwise direction of the gauge block, wherein at least one gauge element within said first series is offset with respect to the first longitudinal axis and from adjacent ones of the gauge elements within said first series in the range of from about 0.005 to 0.100 inches; and a second series of gauge elements disposed on the first gauge block, the gauge elements within said second series being spaced from one another along a second longitudinal axis extending in the lengthwise direction of the gauge block, the second longitudinal axis being spaced from and parallel to the first longitudinal axis, wherein the gauge elements within said second series are aligned with respect to one another and extend linearly along the second longitudinal axis.

62. A tufting needle assembly for use with a tufting machine, the tufting machine having a frame, at least one elongate and reciprocating needle bar supported on the frame and adapted for a lateral shifting motion with respect to the frame, and a series of loopers of a predetermined tufting machine gauge, one series of loopers for each needle bar, positioned with respect to the needle bar, said tufting needle assembly comprising:

a first gauge block adapted to be mounted on the at least one needle bar;

a first series of gauge elements disposed on the gauge block, the gauge elements within said first series being spaced from one another along a first longitudinal axis extending in the lengthwise direction of the gauge block, wherein at least one gauge element within said first series is offset with respect to the first longitudinal axis and from adjacent ones of the gauge elements within said first series in the range of from about 0.005 to 0.100 inches; and a second series of gauge elements disposed on the first gauge block, the gauge elements within said second series being spaced from one another along a second longitudinal axis extending in the lengthwise direction of the gauge block, the second longitudinal axis being spaced from and parallel to the first longitudinal axis, wherein each of the gauge elements within said second series comprises a tufting needle having an elongate needle shank with a proximal end affixed to the gauge block and a spaced distal end defining a needle tip, wherein the needle tip of at least one of the tufting needles in said second series is offset with respect to the second longitudinal axis, and wherein the shanks of the tufting needles within said second series are aligned with respect to one another and extend linearly along the second longitudinal axis.

63. A tufting needle assembly for use with a tufting machine, the tufting machine having a frame, at least one elongate and reciprocating needle bar supported on the frame and adapted for a lateral shifting motion with respect to the frame, and a series of loopers of a predetermined tufting machine gauge, one series of loopers for each needle bar, positioned with respect to the needle bar, said tufting needle assembly comprising:

a first gauge block adapted to be mounted on the at least one needle bar;

a first series of gauge elements disposed on the gauge block, the gauge elements within said first series being spaced from one another along a first longitudinal axis extending in the lengthwise direction of the gauge block, wherein at least one gauge element within said first series is offset with respect to the first longitudinal axis and from adjacent ones of the gauge elements within said first series in the range of from about 0.005 to 0.100 inches;

a second elongate gauge block; and a second series of gauge elements disposed on the second gauge block, the gauge elements within said second series being spaced from one another along a second longitudinal axis extending in the lengthwise direction of the second gauge block, wherein the second longitudinal axis is spaced from and parallel to the first longitudinal axis of the first gauge block, and wherein at least one gauge element of the second series of gauge elements is offset with respect to the second longitudinal axis and from adjacent ones of the gauge elements within said second series.

64. A tufting needle assembly for use with a tufting machine, said tufling needle assembly comprising:

a elongate needle bar;

a first series of spaced tufting needles disposed on the needle bar, the tufting needles being spaced from one another along a first longitudinal axis extending in the lengthwise direction of the needle bar, wherein each tufting needle of said first series of spaced tufting needles comprises an elongate needle shank having a proximal end affixed to the needle bar and a spaced distal end defining a needle tip, and wherein at least one tufting needle within said first series is offset with respect to the first longitudinal axis and from each adjacent one of the tufting needles within said first series in the range of from about 0.005 to 0.100 inches; and a second series of tufting needles affixed to the first needle bar, the tufting needles within said second series being spaced from one another along a second longitudinal axis extending in the lengthwise direction of the needle bar, the second longitudinal axis being spaced from and parallel to said first longitudinal axis, wherein the tufting needles within said second series are aligned with respect to one another and extend linearly along the second longitudinal axis.

65. A tufting needle assembly for use with a tufting machine, said tufting needle assembly comprising:

a elongate needle bar;

a first series of spaced tufting needles disposed on the needle bar, the tufling needles being spaced from one another along a first longitudinal axis extending in the lengthwise direction of the needle bar, wherein each tufting needle of said first series of spaced tufting needles comprises an elongate needle shank having a proximal end affixed to the needle bar and a spaced distal end defining a needle tip, and wherein at least one tufting needle within said first series is offset with respect to the first longitudinal axis and from each adjacent one of the tufting needles within said first series in the range of from about 0.005 to 0.100 inches;

a second elongate needle bar; and a second series of spaced tufting needles disposed on the second needle bar, the tufting needles within said second series being spaced from one another along a second longitudinal axis extending in the lengthwise direction of the second needle bar, the second longitudinal axis being spaced from and parallel to the first longitudinal axis, wherein each tufting needle of said second series of tufting needles comprises an elongate needle shank having a proximal end affixed to the first needle bar and a spaced distal end defining a needle tip, and wherein at least one tufting needle within said second series is offset with respect to the second longitudinal axis and from each adjacent one of the tufting needles within said second series.

66. A tufting needle assembly for use with a tufting machine, said tufting needle assembly comprising:

an elongate needle bar; and a first series of spaced tufting needles disposed on the needle bar and extending in the lengthwise direction thereof along a first longitudinal axis, each tufting needle comprising an elongate needle shank having a proximal end carried on the needle bar and a spaced distal end defining a needle tip, wherein the needle tip of at least one tufting needle within said first series is offset with respect to the first longitudinal axis of the needle bar in the range of from about 0.005 to 0.100 inches;

a second series of tufting needles affixed to the first needle bar, the tufting needles within said second series being spaced from one another along a second longitudinal axis extending in the lengthwise direction of the needle bar, the second longitudinal axis being spaced from and parallel to said first longitudinal axis, wherein the needle tips of the tufting needles within said second series are aligned with respect to one another and extend linearly along the second longitudinal axis.

* * * * *